United States Patent [19]

Eisiminger

[11] 4,316,445

[45] Feb. 23, 1982

[54] COMBUSTION AIR INTAKE SYSTEM FOR WOOD-BURNING STOVE

[75] Inventor: Larry D. Eisiminger, Sweet Home, Oreg.

[73] Assignee: Sweet Home Stove Works, Inc., Sweet Home, Oreg.

[21] Appl. No.: 151,823

[22] Filed: May 21, 1980

[51] Int. Cl.[3] ..... F24B 5/00

[52] U.S. Cl. ..... 126/77; 126/66; 126/290; 126/287

[58] Field of Search ..... 126/77, 193, 287, 290, 126/285 R, 78, 80, 81, 83, 146, 289, 286, 63, 66; 98/48

[56] References Cited

U.S. PATENT DOCUMENTS

| | | | |
|---|---|---|---|
| 595,952 | 12/1897 | Laroche | 126/77 |
| 741,658 | 10/1903 | Grant et al. | 126/290 |
| 4,037,584 | 7/1977 | Fisher | 126/290 |
| 4,184,473 | 1/1980 | McIntire et al. | 126/77 |

*Primary Examiner*—James C. Yeung

*Attorney, Agent, or Firm*—Klarquist, Sparkman, Campbell, Leigh, Whinston & Dellett

[57] ABSTRACT

Hinged doors are provided on the front of a stove for sealably closing across a large opening through which logs can be loaded into a firebox within the stove. A cylindrical draft chamber is formed on an exterior surface of one or each of the doors. A draft cap is rotatable on a threaded stud which is coaxially secured in the cylindrical draft chamber. The draft cap includes an annular flange forming a sliding close-tolerance fit with an interior cylindrical wall of the draft chamber so that the cap can be rotated to vary the size of the draft chamber to selectively restrict the flow of air from a source through the draft chamber to the firebox whenever the doors are closed.

4 Claims, 4 Drawing Figures

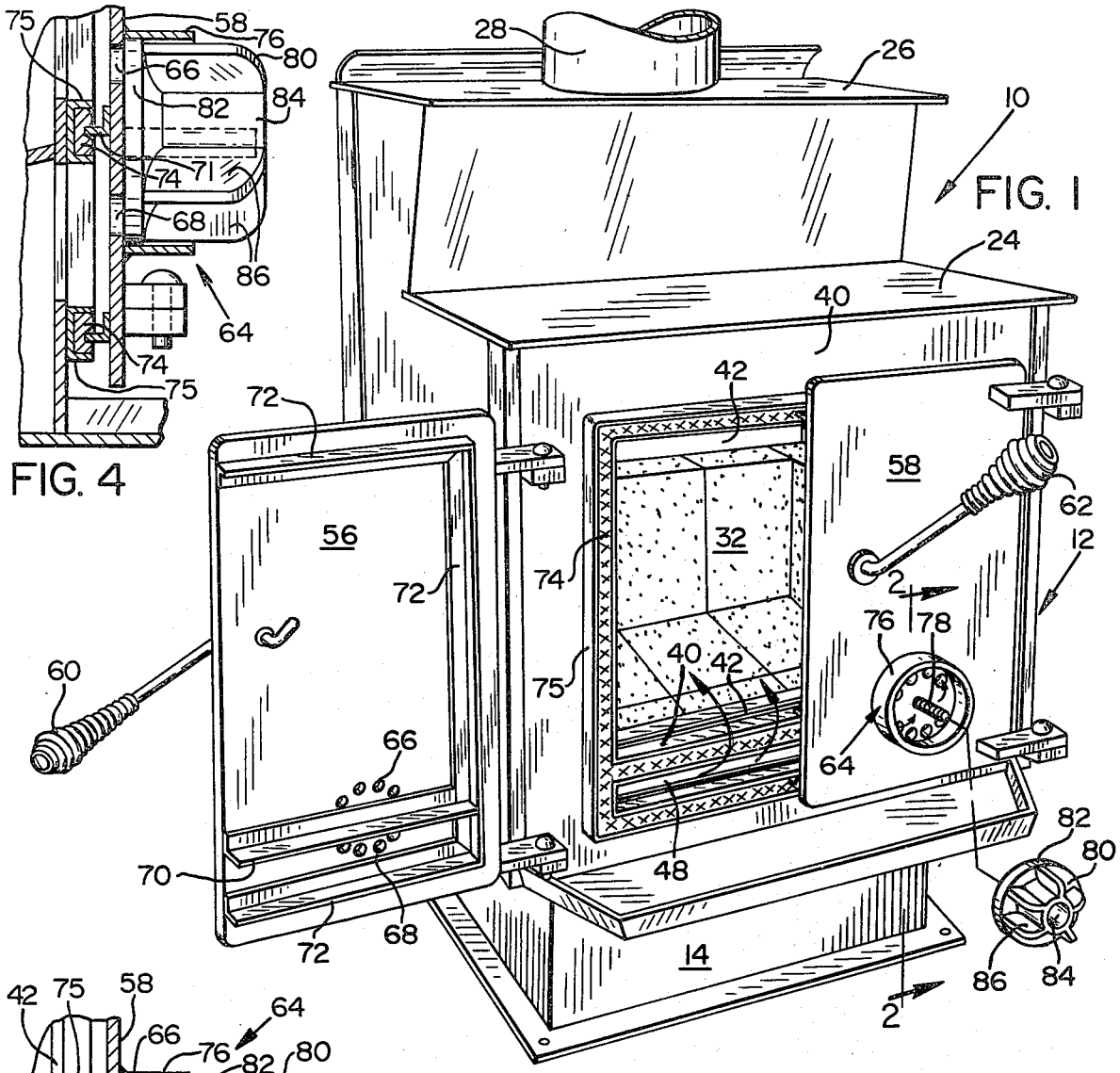
FIG. 1
FIG. 4
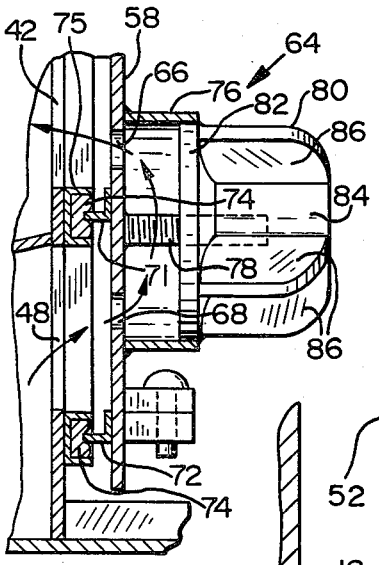
FIG. 3
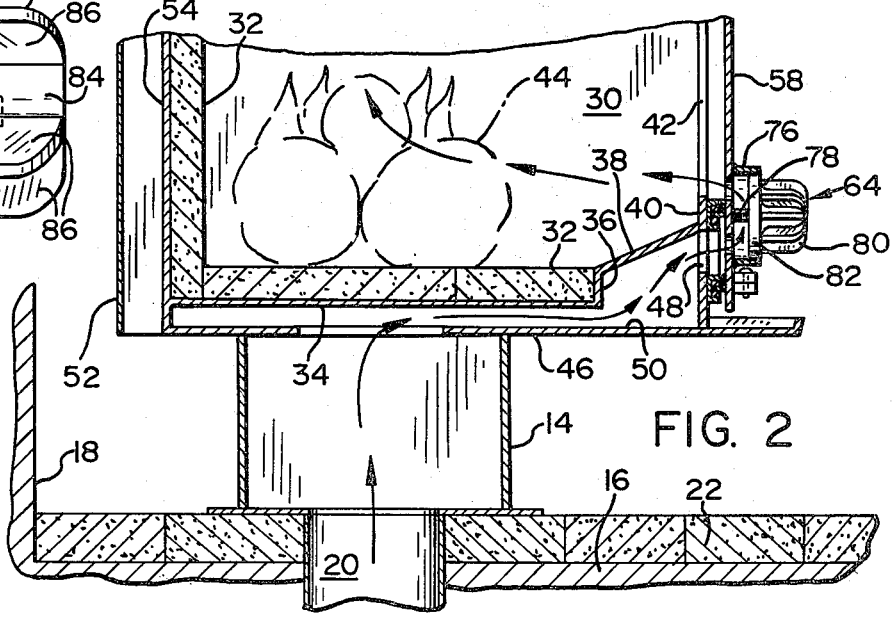
FIG. 2

COMBUSTION AIR INTAKE SYSTEM FOR WOOD-BURNING STOVE

The present invention pertains to improved draft control mechanisms for wood-burning stoves and the like and has for a principal object a provision of a creosol-free draft chamber and mechanism for controlling the flow of combustion air to the fire within the stove.

Other objects as well as various inherent advantages of the invention will become apparent from the following description of the presently preferred way of carrying out the invention, read in conjunction with the accompanying drawing, in which:

FIG. 1 is a perspective view of a stove incorporating an improved draft control mechanism in accordance with the invention;

FIG. 2 is a schematic cross section of a lower portion of the stove and a supporting hearth taken along line 2—2 of FIG. 1;

FIG. 3 is a fragmentary cross-sectional view of a portion of FIG. 2 on a larger scale showing the draft control mechanism in a fully opened position; and FIG. 4 is a fragmentary cross-sectional view similar to FIG. 3 but with the draft control mechanism in a fully closed position.

Referring to FIGS. 1 and 2, a stove in accordance with the invention is indicated generally by reference numeral 10. The stove 10 is of the free-standing type having an upper frame portion 12 supported by a box-like pedestal 14. The stove 10 is particularly well suited for use in dwellings constructed so that access to outside air can be readily achieved through a floor 16 or wall 18 of the dwelling. In the present example, an air intake duct 20 of suitable diameter, such as five inches, extends through a hearth 22 and the floor 16 to the exterior of the dwelling for communicating outside air into the compartment defined by the pedestal 14 from which the air flows to the fire as indicated by the arrows as will be described more fully below. Although the use of outside air for combustion is preferred, it will be appreciated that the improved draft mechanism to be described below has useful application with stoves, fireplace inserts and other heating apparatuses which instead employ inside air for combustion purposes.

With particular reference to FIG. 1, the frame 12 includes horizontal surfaces 24 and 26 which can be used for cooking or pot warming. A chimney pipe 28 extends through the surface 26 to the interior of the stove for conveying exhaust gases to the exterior of the dwelling.

With particular reference to FIG. 2, a firebox 30 is defined by the interior surfaces of steel plates and a conventional firebrick lining 32. A bottom steel plate 34 of the firebox 30 terminates forwardly with a short vertical portion 36 which retains the firebrick lining 32. An ash guard plate 38 extends forwardly with a slight upward inclination from the vertical portion 36 to a front wall 40. The front wall includes a major opening 42 for access to the firebox 30 from the room for loading logs 44 or the like to be burned in the stove 10. A lower exterior wall 46 of the stove defines an airflow passageway indicated by the arrows leading from the compartment within the pedestal 14 to a minor opening 48 in the front wall 40. A preheating chamber 50 is defined within an expanded portion of the airflow passageway defined below the ash guard plate 38. A heat shield is formed at the back of the stove 10 by an air space defined between a vertical outside wall 52 and a back wall 54 of the firebox 30.

Referring briefly again to FIG. 1, the stove 10 of the present example has two large doors 56 and 58 having respective handles 60 and 62, the doors being hinged to close across the openings 42 and 48 in the front wall 40. The firebox 30 and the doors 56 and 58 form the interior walls of the stove's combustion chamber. It will be understood that a stove with only one such door is also contemplated by the present invention.

As seen in FIGS. 1 and 2, a draft control mechanism, generally indicated by reference numeral 64, is mounted on the exterior surface of the right door 58. The draft control mechanism 64 defines a draft chamber which can be varied in size as will be described more fully below. A similar draft control mechanism, which is hidden from view, is provided on the exterior surface of the left door 56. The doors 56 and 58 each have holes or ports divided into upper and lower sets 66 and 68 by means of L-shaped members 70 and 71 mounted on the interior surfaces of the respective doors 56 and 58. Additional L-shaped members, which are commonly designated by reference numeral 72, are mounted on the interior surfaces of the doors 56 and 58 in a rectangular arrangement slightly larger than the region defined by the upper edge of the major opening 42, the lower edge of the minor opening 48 and the vertical side edges of both openings 42 and 48. Mounted on the front wall 40 surrounding and separating the openings 42 and 48 are sealing strips which are commonly designated by reference numeral 74. The sealing strips 74 preferably comprise an elastic heat-resistant material such as a spun ceramic. The sealing strips 74 are provided in C-shaped channels 75 which have their backs affixed to the front wall 40. The outwardly protruding portions of the L-shaped members 70-72 compressively engage the sealing strips 74 when the doors 56 and 58 are closed, thereby isolating the openings 42 and 48 from each other and from the room such that combustion air must flow from the preheating chamber 50 through the minor opening 48 and then the lower ports 68 into the draft chambers and from the draft chambers through the upper ports 66 and then the major opening 42 into the firebox combustion chamber.

Referring now to FIGS. 3 and 4, the details and operation of the draft control mechanism 64 will be described. It will be understood that the following description of the draft control mechanism 64 on the right door 58 and cooperating parts applies as well to the hidden draft control mechanism on the left door 56 and cooperating parts. The draft control mechanism 64 comprises a cylinder 76 surrounding the ports 66 and 68, a threaded stud 78 welded to the door 58 in coaxial relationship to the cylinder 76, and a draft cap or control knob 80 for varying the size of the draft chamber formed within the cylinder 76. The draft cap 80 includes an annular flange 82 corresponding to the inside diameter of the cylinder 76 and a hub portion 84 of a smaller diameter extending axially outward from the flange 82. Extending through the flange 82 into the hub 84 is a threaded bore (not shown) which is adapted to mate with the stud 78. A plurality of webs 86 extend generally radially from the hub 84 and along the flange 82. The webs 86 not only provide mechanical rigidity to the draft cap structure but also provide a convenient means for turning or spinning the draft cap 80 with one's fingers.

With particular reference to FIG. 3, the draft control mechanism 64 is shown in its fully opened position wherein the draft cap 80 is positioned so that the annular flange 82 lies at the outer most edge of the cylinder 76. When the cap 80 is in this position, air can flow freely from the preheating chamber 50 through the opening 48 in the front wall 40, then through the compartment formed between the sealing strips 74, then into the draft chamber through the ports 68. From the draft chamber, air can flow out through the ports 66, and then through the major opening 42 into the firebox combustion chamber. In order to reduce the flow of air through the draft chamber, it is only necessary to turn the draft cap 80 in a clockwise direction so that the flange 82 moves closer to the door 58, thus reducing the size of the draft chamber formed therebetween and progressively restricting the flow of air into the combustion chamber. When the draft cap 80 can no longer be turned in a clockwise direction, the ports 66 and 68 are closed off by the flange 82 resting flush against the door 58 as illustrated in FIG. 4. It will be appreciated that when both doors 56 and 58 are closed and the associated draft control mechanisms are in the fully closed positions, essentially no air is provided to the combustion chamber, there being, of course, some minimal leakage.

From the foregoing description, it will be appreciated that the present invention provides an improved combustion air intake system for wood-burning stoves and the like. An important advantage of the invention over prior art systems is that draft control is undertaken outside of the combustion chamber so that creosol will not collect on the working parts such as the stud 78 and cooperating threaded bore of the draft cap 80. An additional advantage of the invention is that the draft control mechanisms are easily controllable from the room by virtue of being located on the doors 56 and 58 at the front of the stove 10. It will also be appreciated that the minor opening 48 is sufficiently large and appropriately located relative to the major opening 42 so that the fire within the combustion chamber will draw outside air as indicated by the arrows in FIG. 1 in preference to burning the air within the room.

Although a preferred embodiment of the invention has been described in detail, it is to be understood that various changes, substitutions, and alterations can be made therein without departing from the spirit and scope of the invention as defined in the appended claims.

What is claimed is:

1. A wood-burning apparatus for heating a room of a dwelling comprising:

a firebox having a front wall and a major opening in said front wall for access to the firebox from the room for loading logs or the like into the firebox;

door means for closing the opening, the door means and the firebox defining the walls of a combustion chamber;

means for carrying combustion gases from the combustion chamber to the exterior of the dwelling;

first wall means defining a preheating chamber adjacent to the combustion chamber;

air intake means for communicating air from outside the dwelling into the preheating chamber;

second wall means defining a draft chamber, the second wall means forming a part of the door means, the draft chamber being defined on the exterior of the door means, the second wall means including first port means providing fluid communication between the preheating chamber and the draft chamber and second port means providing fluid communication between the draft chamber and the combustion chamber, the first and second port means being formed by holes through the door means, the three chambers otherwise being isolated from each other and from the room when the door means is closed; and draft control means controllable from the room for varying the size of the draft chamber selectively to restrict the flow of air from the preheating chamber to the combustion chamber, the draft control means being operational only when the door means is closed.

2. The apparatus of claim 1 wherein the front wall includes a minor opening disposed along and proximate to an edge of the major opening, the minor opening providing a passageway between the preheating chamber and the draft chamber.

3. The apparatus of claim 2 further comprising elastic seal means disposed between the door means and the front wall, the major and minor openings each being surrounded by the seal means, the seal means being compressed by the door means when closed, thereby isolating the major and minor openings from each other and from the room such that combustion air must flow from the preheating chamber through the minor opening and then the first port means into the draft chamber and from the draft chamber through the second port means and then the major opening into the combustion chamber when the door means is closed.

4. The apparatus of claim 3 wherein the seal means comprises a compressible elastic material disposed in channels having generally C-shaped cross sections, the channels having their backs affixed to the front wall so that the elastic material is exposed at the front, and wherein the door means includes protruding members adapted to extend into the channels to compressibly engage the elastic material.

* * * * *